United States Patent [19]

Gartner

[11] 4,193,698

[45] Mar. 18, 1980

[54] DEVICE FOR RUPTURING A FRANGIBLE PARTITION BETWEEN SEPARATE CHAMBERS IN A CONTAINER

[76] Inventor: Veit Gärtner, Westendstrasse 19c, D-8202 Bad Aibling, Fed. Rep. of Germany

[21] Appl. No.: 10,269

[22] Filed: Feb. 7, 1979

Related U.S. Application Data

[63] Continuation of Ser. No. 851,816, Nov. 16, 1977, abandoned.

[51] Int. Cl.[2] ..... B01F 11/00; B65D 23/04

[52] U.S. Cl. ..... 366/130; 366/313; 206/219

[58] Field of Search ..... 366/129, 130, 150, 308, 366/312, 326, 602, 605, 244, 245, 246, 247, 302, 309, 313, 174; 222/83, 145, 464; 215/DIG. 1, DIG. 8; 206/219, 220, 222

[56] References Cited

U.S. PATENT DOCUMENTS

| | | | |
|---|---|---|---|
| 3,144,966 | 8/1964 | Cook | 206/222 |
| 3,240,391 | 3/1966 | Garton | 206/222 |
| 3,326,533 | 6/1967 | Sturrup | 366/326 |
| 3,537,577 | 11/1970 | Goupil | 206/222 |
| 3,548,562 | 12/1970 | Schwartzman | 206/222 |
| 3,595,421 | 7/1971 | Sanchis | 215/DIG. 1 |
| 3,715,189 | 2/1973 | Nighohossia | 206/222 |
| 3,735,900 | 5/1973 | Gores | 366/130 |
| 3,968,872 | 7/1976 | Cavazza | 206/222 |

FOREIGN PATENT DOCUMENTS

| | | | |
|---|---|---|---|
| 2270163 | 12/1975 | France | 206/222 |

*Primary Examiner*—Robert W. Jenkins
*Attorney, Agent, or Firm*—James E. Nilles

[57] ABSTRACT

A package for materials that are to be mixed shortly before use comprises a compartmented container and a device for rupturing a frangible partition member in the container. The device comprises a shaft having an upper end connected with a closure for a top opening in the container. Resilient arm-like vanes project radially from the shaft near a pointed lower end thereof and have their tips engage inner wall surfaces of the container under bias to hold the shaft coaxial. Downward movement of the device causes the point on the shaft and sharp bottom edges on the vanes to cooperate in completely rupturing the partition member, and the device then remains in a position in which the vanes break up and stir the materials as the container is shaken.

11 Claims, 8 Drawing Figures

P

DEVICE FOR RUPTURING A FRANGIBLE PARTITION BETWEEN SEPARATE CHAMBERS IN A CONTAINER

This application is a continuation of my copending application, Ser. No. 851,816, filed Nov. 16, 1977, now abandoned. My application Ser. No. 851,817, filed Nov. 16, 1977, now abandoned covers related subject matter.

This invention relates to a device for cooperation with a compartmented container wherein unlike materials are separately stored and wherein the materials can be mixed shortly before use; and the invention is more particularly concerned with a compartmented container wherein there is a device which enables a frangible partition in the container to be readily ruptured, so that the materials stored in the container can be brought into contact with one another, the device thereafter serving as a baffle or deflector that promotes thorough mixing of the materials when the container is shaken.

It often happens that materials which are to be combined into a mixture must be stored separately from one another until shortly before the mixture that they form is to be used, because the mixture breaks down, deteriorates or undergoes a chemical change within a short time after mixing takes place. Typically this occurs with medicines, with certain chemicals such as epoxy resins and foamed plastics, and with certain foods and beverages. In such cases the component materials must usually be combined in rather accurate proportions, and it is desirable that the user be supplied with measured amounts of the materials, stored separately but packaged to be handled as a unit. In many cases it is also desirable that mixing of the component materials take place in a closed container, as where harmful fumes are emitted during mixing.

Component materials for such a mixture can be conveniently stored and handled in a compartmented container wherein accurately proportioned quantities of the several materials are stored and are separated from one another by one or more partition members that extend across the interior of the container. Known compartmented containers for this purpose have had frangible partition walls that could be ruptured to bring the separately stored materials into contact with one another so that they could be mixed by agitation of the container. Rupture of the partition or partitions was effected by means of a pointed or sharp-edged piercing or cutting tool that projected out of the container through a duct and was actuatable from the exterior of the container.

The prior partition rupturing devices tended to produce a rather small aperture in the partition, and thus provided for only a restricted flow between compartments. Therefore, unless the materials in the individual compartments were relatively flowable and rather readily miscible, very prolonged and vigorous agitation of the container was required for mixing them; and with viscous, pasty or slowly flowing materials, or in a case where one of the materials to be mixed was a solid, complete and thorough mixing might be practically unattainable. If, on the other hand, the partition film or membrane was of such character that it ruptured completely once it had been pierced, or if the tool was of such character that it effected complete rupture of the partition, then the absence of any sort of baffle or vane inside the container made it difficult to get a fast and complete mixing of component materials that were not readily flowable and miscible.

By contrast, it is a general object of the present invention to provide a device or tool for cooperation with a compartmented container having a frangible partition member, whereby a very extensive rupturing of the partition member can be quickly and easily effected, to allow rapid and extensive contact between materials at its opposite sides, and whereby baffles or turbulence-producing vanes are provided that promote fast and complete mixing of the materials with one another when the container is shaken.

Another object of the invention is to provide a tool or device for cooperation with a compartmented container of the character described that not only serves for quick and easy rupturing of a frangible partition member that separates the compartments of the container but also serves to ensure that mere shaking of the container will effect a quick and thorough mixing of the container contents without the need for employing supplementary means or measures.

Another and more specific object of the invention is to provide a tool or device of the character described which can be produced so inexpensively as to be well suited for one-time use, and which is adapted to be supplied with materials in a compartmented container either as an installation that is already in the container at the time the user receives it or as a separate device that can be readily installed in the container at the time its contents are to be mixed for use.

Another specific object of the invention is to provide a compartmented container in which there is a rupturing device of the character described that resists axial displacement in the container both before and after the device is employed for rupturing a frangible partition member, but wherein said device can nevertheless be deliberately displaced for such rupturing and can thereafter occupy a position such that portions of it are very effective, upon shaking of the container, to stir and break up the materials in the container and thus promote a very quick and thorough mixing of those materials.

A further specific object of the invention, realized in certain embodiments of it, is to provide a compartmented container wherein there is a device of the character described that serves as a tool rupturing a frangible partition member in the container, then serves to break up and stir the contents of the container when the container is shaken, and, finally, provides an outlet spout through which the mixed contents of the container can be dispensed but which is normally sealed and can be opened by cutting off and end portion thereof.

It is also a specific object of this invention to provide a device of the above described character which can be inserted into a compartmented container through a relatively narrow-necked opening therein but which nevertheless has portions that spring out or expand when inside the container to extend entirely across the interior of the container and serve to break up and stir the container contents during agitation of the container.

An additional specific object realized in certain embodiments of the invention is to provide a tool or device of the character described which serves as a stopper or closure whereby an outlet in a compartmented container is sealed, and which can be so formed that the closure is sealed more or less simultaneously with rupture by the device of a frangible partition member in the container.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of embodiments of the invention constructed according to the best modes so far devised for the practical application of the principles thereof, and in which.

Figure 8:
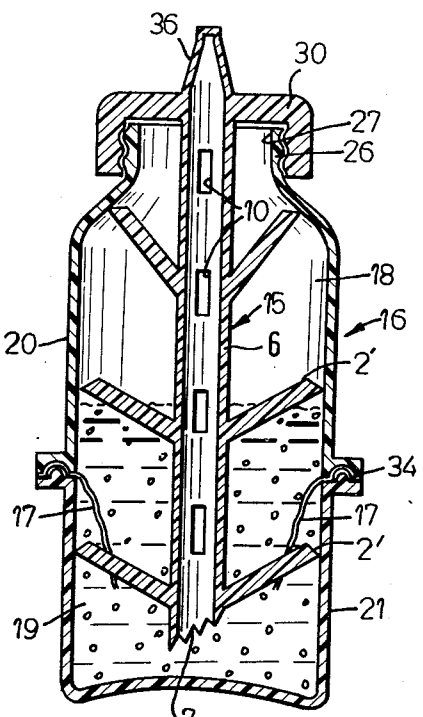
Figure 7:
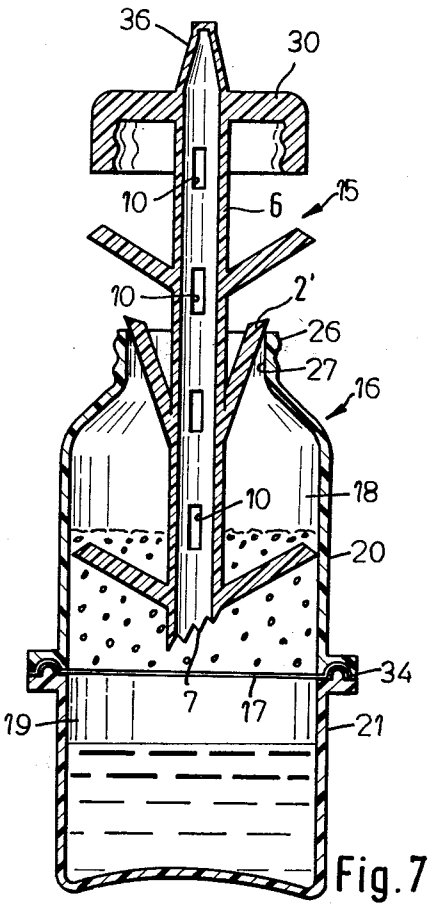
Figure 6:
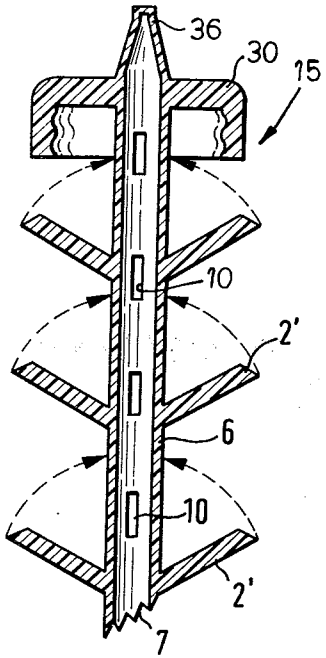
FIG. 6 is a view in longitudinal section of still another embodiment of the rupturing device of this invention.

FIG. 7 is a view in longitudinal section showing the device of FIG. 6 in the course of being installed in a compartmented container with which it is intended to cooperate; and FIG. 8 is a view corresponding generally to FIG. 7 but showing the device fully installed in the compartmented container and in the condition in which the container contents can be rapidly and thoroughly mixed merely by shaking the container.

Referring now more particularly to the accompanying drawings, a rupturing device of this invention which is designated generally by 15, is intended to cooperate with a compartmented container 16 that has a frangible partition member 17 extending across its interior to define an upper compartment 18 and a lower compartment 19.

The particular container 16 here illustrated comprises an upper container member 20 and a lower container member 21, both of which can be made of resilient plastic and which are connected with one another at or near the middle of the container. The lower container member 21 is substantially cupshaped and has an elongated-diameter internally threaded rim portion 22. The upper container member 20 has a substantially cylindrical lower portion 24 and a thin-walled frustoconical medial portion 25 that tapers upwardly to an upwardly projecting neck 26 which defines an outlet opening 27 in the top of the container. The upper container member 20 also has a thickened lower edge portion 29 that is externally threaded to mate with the internally threaded rim portion 22 on the lower container member.

The frangible partition member 17 can be a membrane of a suitable paper, film, foil or the like that is normally impermeable to materials stored in the compartments 18 and 19 which the partition member defines. To seal those compartments from one another, the partition member is clampingly confined, all around its marginal edge portion, between the threadedly connected portions 22 and 29 of the lower and upper container members 21 and 20. The material to be stored in the lower compartment 19 is of course loaded into the cup-shaped lower container member 21 before the container members 20 and 21 are connected with one another and with the partition member 17. Material to be stored in the upper compartment 18 can be charged into it through the outlet oening 27. When the partition member 17 is in place and unbroken, it is substantially flat and normal to the container axis, so that it is spaced from and faces the opening 27.

Figures 1, 2, 3:
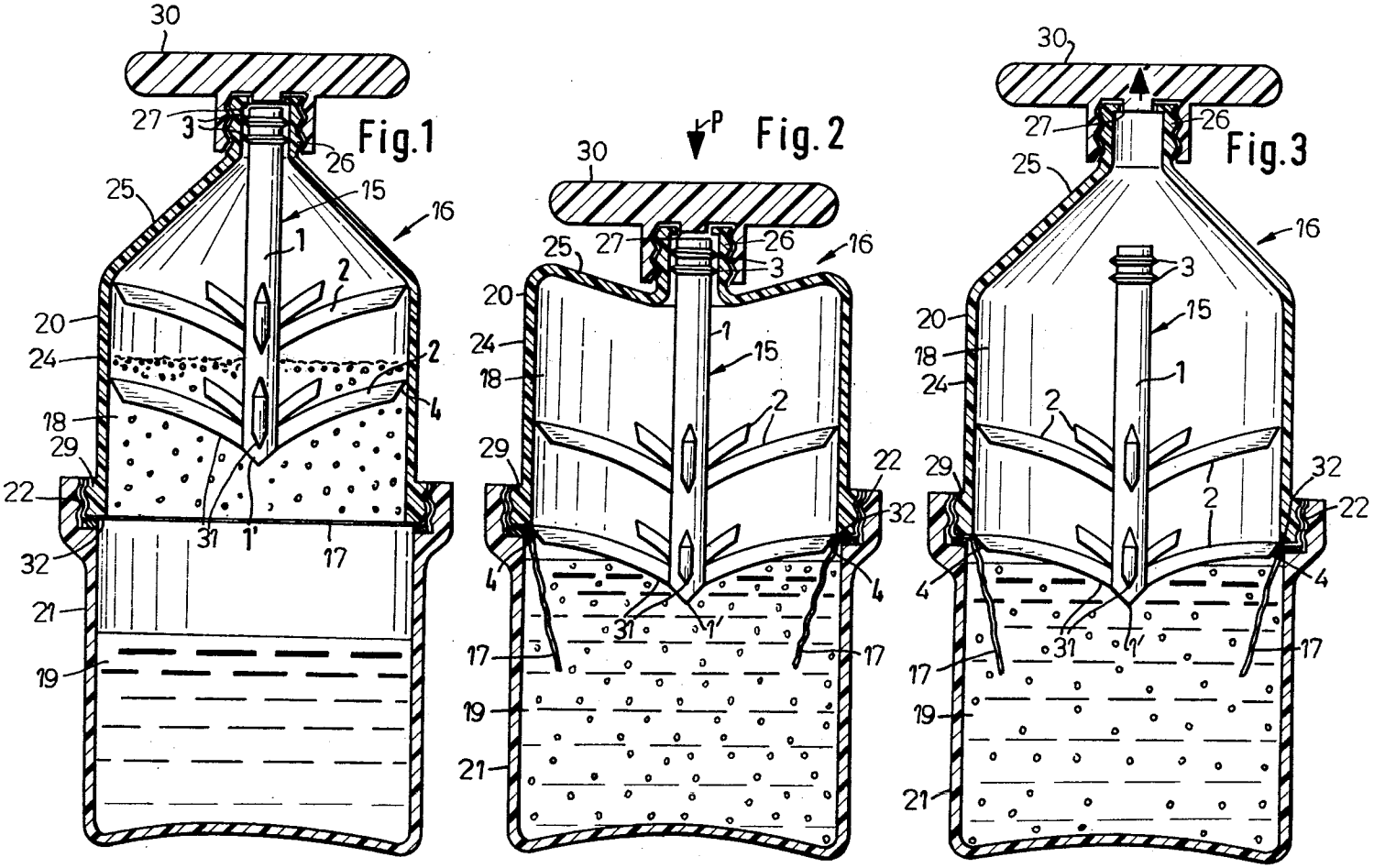
FIG. 1 is a view in longitudinal section of a compartmented container and a cooperating partition rupturing device, embodying the principles of this invention, the device being shown installed in the container but in an inoperative condition.
FIG. 2 is a view generally similar to FIG. 1 but illustrating how the rupturing device can be brought into rupturing engagement with a frangible partition member in a compartmented container having elastic walls.
FIG. 3 is a view generally similar to FIGS. 1 and 2 but showing the device of this invention in an operative position which it occupies after rupture of the partition member and in which it serves to break up and stir the container contents as the container is shaken.

In the case of the container 16 that is illustrated in FIGS. 1–3, the device 15 of this invention is installed in the upper compartment 18 before the upper and lower container members are assembled with one another, so that the consumer receives the container as a complete, compact, selfcontained package, with the correct amounts of the component materials separately stored and capable of being quickly and thoroughly mixed within the container in a few simple operations as described hereinafter.

In general, the device of this invention comprises a central shaft 1, a plurality of arm-like vanes 2 that project radially outwardly from the shaft 1, and a cap or closure member 30 for the opening 27 in the container. As the device is installed in a container, the shaft 1 will usually extend along the container axis so that it has top and bottom ends, and at its top end the shaft has a connection with the cap or closure member 30.

The cap 30 can be internally threaded for sealing cooperation with external threads on the neck 26 at the top of the container. The connection between the cap and the upper end of the shaft 1 need only be such that the shaft is constrained to move downwardly with downward movement of the cap, and, as shown in FIGS. 1–3, comprises an abutment on the interior of the cap that opposes the top end of the shaft.

The bottom end of the shaft is formed as a point 1' (as shown in FIGS. 1–5) or (as shown in FIGS. 6–8) as a ring of tooth like points 7, so that the shaft can readily pierce through the frangible partition member 17 when the device is forced downwardly in the container.

The arm-like vanes 2 are arranged in sets, with at least three vanes in each set and with one set located close to the bottom end of the shaft and one or more additional sets of vanes spaced above that lowermost set. As shown, there are four vanes 2 in each set, in a cross-shaped arrangement, and as illustrated in FIGS. 1–3 there are two sets of vanes on the shaft. Each of the vanes 2 is more or less flat, with opposite surfaces that extend generally parallel to the shaft axis. The vanes 2 of at least the lowermost set have sharp bottom edges 31 that cooperate with the point 1' on the bottom of the shaft to pierce and cut through the partition member 17 as the device 15 is forced downward, thereby rupturing the partition member so completely that it offers little or no opposition to flow of materials between the upper and lower compartments 18 and 19.

In the embodiment of the invention illustrated in FIGS. 1–3, the length of the shaft 1 of the device 15 is somewhat less than the height of the upper compartment 18, so that with the cap 30 installed on the container and the device 15 in a storage position in which the upper end of its shaft 1 is adjacent to the cap, as illustrated in FIG. 1, the pointed lower end of the shaft is spaced a small distance above the partition member 17. The device can be frictionally retained in this storage position by means of flange-like rings 3 that surround the upper end portion of the shaft and engage against the inner surface of the neck 26 under radially outward bias. The rings 3 thus cooperate with the neck 26 in assuring a good seal for the upper compartment 18 of the container, even if the cap 30 should become somewhat loose.

The arm-like vanes 2 are of resilient material and are preferably long enough so that their outer ends engage the side wall of the container under outward bias, providing a friction which also serves to inhibit movement of the device 15 out of its storage position. The vanes 2 should be long enough to extend across at least a major portion of the distance from the shaft 1 to the wall of the upper compartment 18 of the container so that the device 15 derives axial guidance from the container wall as it is forced downward for rupturing of the partition member 17.

When the materials stored in the upper and lower compartments 18 and 19 of the container 16 are to be mixed, downward force is applied to the cap or closure 30, as indicated by the arrow P in FIG. 2, thus causing the thin, flexible wall of the frustoconical portion 25 of the upper container member to be yielding so that the device 15 is driven downwardly against the friction which the tips of the vanes 2 preferably exert against the container wall. During such downward motion of the device, with the vanes 2 holding the shaft 1 substantially concentric to the container axis, the partition member 17 is first pierced by the pointed lower end of the shaft 1 and then progressively sliced through by the sharp edges 31 on the lower set of vanes, to be thus completely ruptured.

Preferably the inside diameter of the lower container member 21 is somewhat larger than that of the upper container member 20, so that the lower edge of the upper container member defines a downwardly facing circumferential shoulder 32 in the interior of the container. The vanes 2 of at least the lowermost set have their tips formed as nose-like abutments 4; and, after the partition member 17 has been ruptured, the resilient radially outward bias on the vanes causes these abutments 4 to engage under the shoulder 32 and prevent upward return movement of the device.

Preferably all of the vanes 2 extend radially outwardly from the shaft at a small upwardly oblique angle to it. This upward inclination of the vanes relative to the shaft facilitates downward displacement of the device 15 relative to the container, as the tips of the vanes slide along the inside surface of the container side wall, and also ensures that the abutment portions 4 on the tips of the vanes will securely engage under the shoulder 32 and lock the device against upward displacement. It will be apparent that with the vanes so inclined, the cutting edges 31 on the lowermost set of vanes will slice through the partition member with a progressive radially outward cutting action that cooperates nicely with the piercing performed by the pointed bottom end of the shaft 1.

After the partition member is completely ruptured, the upper portion of the container either springs back to its original configuration by its own resilience or is manually pulled back to that configuration. This enlarges the interior volume of the container to permit the container contents to be mixed by shaking of the container. When the upper portion of the container moves back to its original configuration, the neck 26 of the container pulls away from the upper end of the shaft 1, notwithstanding friction of the rings 3, because of the engagement of the abutment portions 4 on the vanes 2 under the shoulder 32. This is to say that the device 15 remains in a mixing position (see FIG. 3) to which it was driven downwardly during rupturing of the partition member 17 and in which it is maintained substantially coaxial with the container by the cooperation of the axially spaced sets of vanes with the container side wall.

With the device 15 in its mixing position, its lowermost vanes 2 are substantially in the plane of the ruptured partition member 17 and are thus in a zone between the materials stored in the upper and lower compartments 18 and 19. As the container is shaken, after rupture of the partition member, the respective materials must pass the zone occupied by the lower set of vanes 2; and since those vanes extend across the interior of the container, the materials are necessarily stirred and broken up by the vanes in the course of being propelled axially back and forth in the container by the shaking of it. Of course the other vanes on the shaft also contribute to turbulent stirring and mixing of the materials. For reasons pointed out above, shaking of the container has no tendency to dislodge the device 15 from its mixing position shown in FIG. 3.

Thorough mixing of the container contents can thus be accomplished very quickly. Upon removal of the cap or closure member 30, the mixture can be freely discharged through the outlet 27 in the top of the container, which is no longer blocked by the plug-like upper end portion of the shaft with its sealing rings 3.

Figure 4:
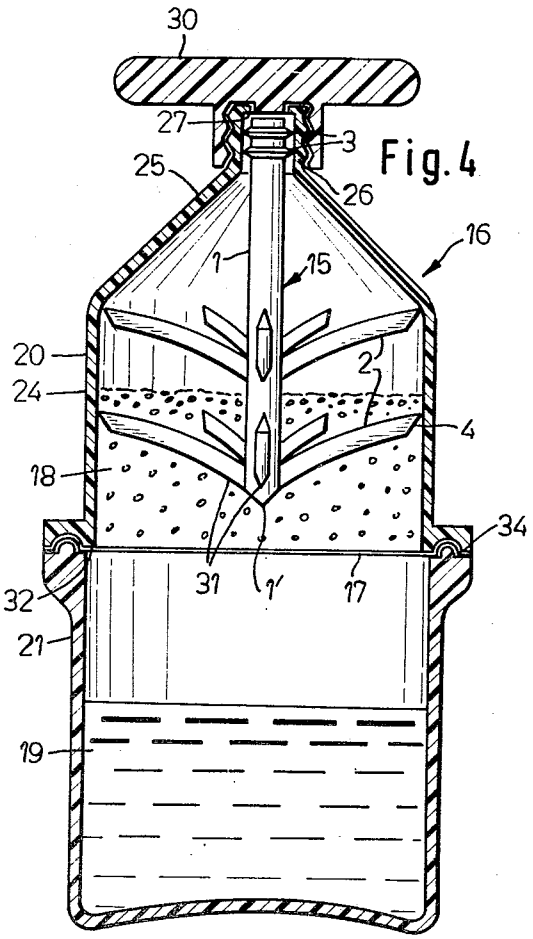
FIG. 4 is a view corresponding generally to FIG. 1 but illustrating a somewhat modified embodiment of the invention.

In the embodiment of the invention shown in FIG. 4, the container is formed somewhat differently that as shown in FIGS. 1–3, in that the upper and lower container members have an abutting connection 34 that comprises opposing surfaces between which the partition member 17 is clamped and which are bonded to one another. In this case the upper portion of the shaft has a loose sliding fit in the neck 26 of the container, since it is assumed that the particular material stored in the upper compartment 18 is not one that requires an especially good seal at the outlet 27. In this case the device 15 is frictionally confined in its storage position, in which it is illustrated in FIG. 4, only by engagement of the resiliency biased vanes 2 against the side wall of the container. In all other respects the container and the device 15 are identical to those of FIGS. 1-3.

Figure 5:
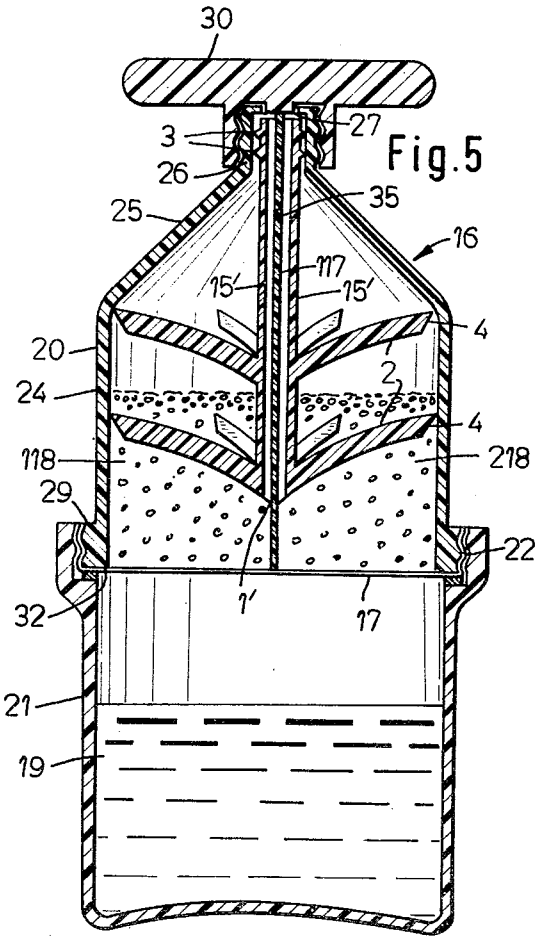
FIG. 5 is a view corresponding generally to FIGS. 1 and 4 but illustrates a further modified embodiment of this invention.

In the embodiment of the invention illustrated in FIG. 5 the container 16 is formed similarly to the container illustrated in FIGS. 1–3, but the upper compartment 18 in the container is subdivided by a second, vertically extending frangible partition member 117 into side-by-side chambers 118 and 218, which can contain two different materials that are to be mixed with one another and with a third material in the lower compartment 19 just before a mixture of the three materials is to be used. In this case two devices 15' of this invention are installed in the upper compartment 18, each corresponding to a longitudinally divided half of the device 15 illustrated in FIGS. 1–3, each half being located at its own side of the upright partition member 117. Considered in another way, the devices 15' illustrated in FIG. 5 can together be regarded as identical with the device 15 illustrated in FIGS. 1–4 except for the presence of a slit 35 along the full length of the shaft 1, to accommodate the vertically extending partition member 117.

The embodiment of the invention illustrated in FIGS. 6–8 is intended to be supplied along with, but outside of, a compartmented container 16 which can be generally similar to the containers illustrated in FIGS. 1–5; but in this case the container preferably has a relatively large diameter neck 26 at its upper end that defines a rather large outlet opening 27. As the consumer receives the container, its opening is closed by a separate cap (not shown) that is removed before the rupturing and mixing device 15 of this invention is inserted into it.

In this case the shaft 6 of the device is hollow and tubular along substantially its entire length, and a cap or closure 30 is rigidly secured to its upper end portion but is spaced a distance below the upper extremity of the shaft. The hollow shaft 6 is open at its lower end, where it is formed with a ring of downwardly projecting, pointed, toothlike piercing elements 7. The tubular shaft 6 has a length substantially greater than the height of the upper compartment 18 in the container, so that insertion of the device into the container causes the partition member 17 to be ruptured before the cap or closure 30 can be screwed onto the neck 26; and when the cap is in place, the device projects a substantial distance into the lower compartment 19 through the ruptured partition member 17. To ensure that adequate turbulence will be imparted to the container contents as the container is being shaken, the device has several sets (three, as shown) of vane-like elements 2' projecting from its shaft at uniformly spaced intervals along the length thereof. One such set of vane-like elements is located near the lower end of the shaft, as in the previously described embodiments, to cooperate with the pointed lower end of the shaft in rupturing the partition member 17. One other set of elements 2' is so located along the shaft as to ensure that both of the component materials will be stirred and broken up as the container is shaken.

The entire device, including the cap 30, can be molded in one piece, of a resilient plastic. The resilience of the vane-like elements 2' and their oblique upward inclination to the shaft 6 enables them to be cammed inwardly against their resilient bias as they pass through the opening 27 in the container, as illustrated in FIG. 7.

Projecting above the cap 30 is a portion 36 of the tubular shaft 6 which has its hollow interior in communication with the hollow interior of the remainder of the shaft, but which is closed at its upper end. After the material in the container is mixed, the closed upper tip portion of the hollow shaft 6 can be cut off with a scissors or a knife, and the remaining portion of the hollow shaft that projects above the cap 30 can then serve as a spout through which the container contents can be dispensed. To enable the container to be emptied completely, the wall of the hollow shaft 6 has inlet apertures 10 therethrough, at intervals along its length.

From the foregoing description taken with the accompanying drawings it will be apparent that this invention provides a simple and very inexpensive compartmented container that holds component materials which are not to be mixed until shortly before a time of use, together with a cooperating tool or device that facilitates complete rupture of a frangible partition member in the container, serves as a closure for the container, and provides for fast and thorough mixing of the container contents as the container is shaken.

Those skilled in the art will appreciate that the invention can be embodied in forms other than as herein disclosed for purposes of illustration.

The invention is defined by the following claims:

1. In combination with a container comprising substantially concentric upper and lower container members which cooperate with a partition member to define upper and lower compartments for separate storage of different materials that are to be mixed with one another shortly before use, said upper container member having a side wall portion that extends upward from said partition member and having a downwardly displaceable top portion, a rupturing and agitation device characterized by:

A. a shaft long enough to extend through at least a substantial part of the distance from said downwardly displaceable top portion of the container to said partition member, said shaft being slender along its length so as to be spaced radially a substantial distance from said side wall portion of the upper container member, said shaft (1) having a substantially sharp point at a lower end thereof whereby said partition member can be pierced, and (2) having an upper end portion cooperable with said downwardly displaceable top portion of the upper container member to be moved downward by downward displacement thereof; and B. at least three vanes secured to said shaft near the lower end thereof, (1) each of said vanes projecting substantially radially from the shaft through at least a substantially major part of said distance to said side wall portion so that the vanes can cooperate with said side wall portion in confining the shaft against substantial tilting out of coaxial relation to the container as the shaft is moved down to pierce the partition member, (2) said vanes being formed to cooperate with said point on the shaft in rupturing the partition member upon downward axial displacement of the shaft in the container, and (3) each of said vanes being further formed to impart substantial turbulence to material flowing in directions parallel to the shaft, so that after rupture of the partition member the vanes can serve as baffles which stir and break up the contents of the container when the container is shaken.

2. The combination of claim 1 wherein each of said vanes is arm-like and extends a substantially smaller distance in the direction parallel to the shaft than radially to it, so that the vanes can impart turbulence to material flowing in directions substantially parallel to the shaft.

3. The combination of claim 2, further characterized by:

C. a further plurality of elongated arm-like vanes secured to said shaft intermediate its ends and projecting substantially radially from the shaft; and D. every vane on the shaft being (1) resiliently flexible along its length and (2) long enough to have its radially outer end engaged under radially outward bias with said side wall portion of the upper container member, for frictionally retaining the device against axial displacement in the container while also cooperating with the outer vanes to confine the device against lateral displacement relative to the container.

4. The combination of claim 3, further characterized by:

each of said vanes extending lengthwise from the shaft at an upwardly and radially outwardly oblique inclination thereto.

5. The combination of claim 1, further characterized by:

each of said vanes having a substantially sharp lower cutting edge for cutting through the partition member to facilitate complete rupture thereof.

6. The combination of claim 1 wherein said downwardly displaceable top portion of the upper container member comprises an upper wall portion of said upper container member that defines an upwardly projecting neck surrounding an outlet, further characterized by:

resilient sealing means surrounding the upper end portion of the shaft and arranged to engage the inner surface of said neck, all around the same, under radially outward bias, for sealing said outlet.

7. The combination of claim 1 wherein said downwardly displaceable top portion of the upper container member comprises an upper wall portion of said upper container member that defines an upwardly projecting neck surrounding an outlet, further characterized by:

(1) said shaft (a) being secured at its upper end to a closure for said outlet and (b) being longer than the distance from the top of the neck to the partition member so that the shaft punctures the partition member upon installation of the closure on said neck; and (2) each of said vanes (a) being resiliently flexible along its length, and (b) being inclined radially outwardly and upwardly from the shaft, so that the vanes can readily pass through said neck by radially inward and upward flexure as the device is inserted into the container.

8. The combination of claim 1 wherein said downwardly displaceable top portion of the upper container member comprises an upper wall portion of said upper container member that defines an upwardly projecting neck surrounding an outlet, and a closure member for said outlet, further characterized by:

(1) the upper end portion of said shaft being sealingly connected with said closure member and projecting a distance above the same;

(2) said shaft being tubular along substantially its entire length and being open at its bottom end but closed at its top end; and (3) the upper end portion of said shaft being readily severable from the remainder of the shaft at a zone between its closed top end and the closure member, so that the contents of the container can be discharged through the hollow interior of the shaft, with the remaining portion of the shaft that projects above the closure member serving as a discharge spout.

9. The combination of claim 8, wherein said shaft has apertures in its tubular wall, at intervals between its bottom and the closure member, to provide for complete discharge of the container contents through the tubular shaft.

10. The combination of claim 1 wherein the lower container member has a larger inside diameter than the upper container member to define a downwardly facing circumferential abutment adjacent to the underside of the partition member, further characterized by:

(1) each of said vanes being resiliently flexible along its length, (2) each of said vanes being long enough to have its radially outer end engaged under radially outward bias with said side wall portion of the upper container member, and (3) each of said vanes having an abutment portion at its outer end which is engageable under said circumferential abutment to preclude upward displacement of the device after the partition member is ruptured.

11. The combination of claim 1, further characterized by:

(1) a second frangible partition member in said upper container member, extending thereacross and vertically upwardly from the first-mentioned partition member to divide the interior of the upper container member into two compartments; and (2) said shaft having an elongated slot therein that opens to its bottom end and in which said second partition member is received.

* * * * *